United States Patent [19]

Vosika

[11] 4,351,376

[45] Sep. 28, 1982

[54] LOG SPLITTING BLASTING WEDGE AND ANCHOR SYSTEM

[76] Inventor: Albert F. Vosika, Rte. 2, Crete, Nebr. 68333

[21] Appl. No.: 307,782

[22] Filed: Oct. 2, 1981

[51] Int. Cl.[3] ..... B27L 7/00

[52] U.S. Cl. ..... 144/193 G; 89/1 B; 248/669

[58] Field of Search ..... 89/1 B; 144/193 A, 193 G; 248/125, 669

[56] References Cited

U.S. PATENT DOCUMENTS

| | | | |
|---|---|---|---|
| 1,533,579 | 4/1925 | Webber | 144/193 G |
| 1,795,573 | 3/1931 | Nowalk | 248/669 |
| 1,965,136 | 7/1934 | Crume | 89/1 B |
| 2,991,966 | 7/1961 | Varel | 248/669 X |
| 3,464,655 | 9/1969 | Schuman | 248/669 X |

*Primary Examiner*—W. D. Bray

*Attorney, Agent, or Firm*—Zarley, McKee, Thomte, Voorhees & Sease

[57] ABSTRACT

An apparatus for supporting a blasting wedge relative to a log to be split includes an elongated base frame having forwardly extended tines onto which one end of a log is rolled. A charged blasting wedge is removably supported on a carriage structure which is vertically adjustably supported on an upright backing structure for aligning the wedge with the center of the log. The backing structure is braced relative to the base frame. An improved blasting wedge includes an elongated body having a forwardly tapered forward end portion, a generally cylindrical middle portion and a solid rearward end portion. Multiple longitudinally spaced-apart wick holes are provided through the body in communication with a central bore which is adapted to receive the blasting powder.

17 Claims, 11 Drawing Figures

LOG SPLITTING BLASTING WEDGE AND ANCHOR SYSTEM

BACKGROUND OF THE INVENTION

The present invention is directed generally to an improved apparatus and method for splitting logs with a blasting wedge and more particularly to a system for safely and securely anchoring the wedge relative to a log to be split.

Blasting wedges have been used in the past for splitting logs but such use has been practically unheard of in recent years. This may be partially due to the difficulty of properly backing the wedges and the associated danger of blasting with a poorly backed wedge.

Presently, logs are most commonly split with hydraulic log splitters. These include a device for bracing one end of a log while a wedge is driven into the opposite end with a hydraulic ram for splitting the log. These apparatus require that the logs be cut with a chain saw down to approximately two foot lengths and each individual length may have to be split several times for splitting into pieces of manageable size. Much time and labor is expended in this process. Furthermore, hydraulic log splitters which are capable of splitting relatively large logs on the order of three or more feet in diameter are generally heavy stationary pieces of equipment which are transported to and from a job site on a trailer. Considerable handling of the logs is required for carrying them to and from the splitter. Finally, the hydraulic log splitters are prohibitively expensive for many users.

Accordingly, a primary object of the invention is to provide an improved apparatus and method for splitting logs with a blasting wedge.

Another object is to provide a portable one-man log splitting system.

A more specific object is to provide a log splitting system including a lightweight portable blasting wedge anchor assembly.

Another object is to provide a structure which utilizes the weight of a log for anchoring a wedge support structure.

Another object is to provide a single blasting wedge support apparatus which is adjustable for use with logs of varying diameter.

Another object is to provide a log splitting system capable of readily splitting logs of up to ten feet in length into multiple pieces in a single blasting operation.

A related object is to provide an improved blasting wedge adapted for efficient use with various sized charges of blasting powder.

Finally, an object is to provide an improved log splitting blasting wedge and anchor system which are simple and rugged in construction, economical to manufacture and safe and efficient in operation.

SUMMARY OF THE INVENTION

An apparatus for anchoring a log relative to a blasting wedge includes an elongated base frame having forwardly extended tines onto which one end of a log is rolled. A charged blasting wedge is removably supported on a carriage structure which is vertically adjustably supported on an upright backing structure for alignment of the wedge with the center of logs of various diameters. An elongated brace extends from the top of the backing structure to the rearward end of the base frame.

The apparatus is lightweight and adapted to be carried by one man to the location of a log to be split. The log is simply rolled onto the forwardly extended tines after which the apparatus is driven forwardly with a sledge hammer or the like to embed the wedge into the end of the log, whereupon the charge is detonated and the log is split into multiple pieces from the single blast. This system is readily adapted for splitting logs of six foot, eight foot and ten foot lengths, thereby eliminating the sawing of the logs into shorter two foot lengths, for example. Furthermore, since the blasting wedge is not limited to splitting a log in half, a single blasting operation is operative for splitting a log into multiple pieces. Since a small amount of blasting powder goes a long way in log splitting operations, the practice of the present invention involves only minimal expense. Likewise, the anchor assembly may be economically manufactured, and preferably may be collapsed for storage and transport in a relatively flat container.

The improved blasting wedge of the present invention includes an elongated body having a forwardly tapered forward end portion, a generally cylindrical middle portion and a solid rearward end portion. A bore extends through the middle and forward portions and opens through the forward end of the wedge. A first wick hole is positioned in the middle portion in spaced relation from both the forward and rearward portions and a second wick hole is provided at a position forwardly of the first wick hole. Accordingly, varying amounts of relatively slow burning blasting powder or the like may be used depending upon the size and hardness of the log to be split, with efficient detonation being assured by the choice of longitudinally spaced-apart wick holes.

Accordingly, the present invention provides a most economical and portable system whereby a single man may easily split long large diameter logs.

DESCRIPTION OF THE PREFERRED EMBODIMENT

Figure 1:
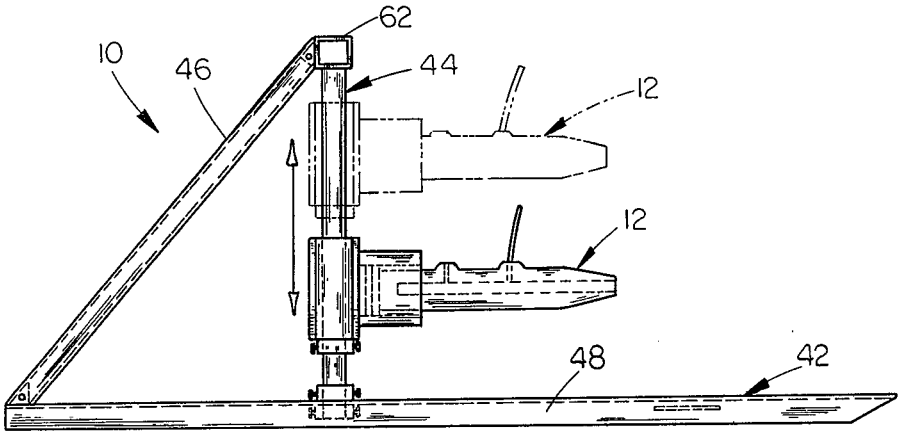
FIG. 1 is a side elevational view of the blasting wedge and anchor structure of the invention.

The anchor structure 10 and blasting wedge 12 of the present invention are shown in FIG. 1 in assembly relation. The anchor structure 10 serves to properly position the blasting wedge 12 relative to a log to be split as well as provide backing to prevent the wedge from being removed from the end of the log by recoil forces upon detonation.

Figure 2:
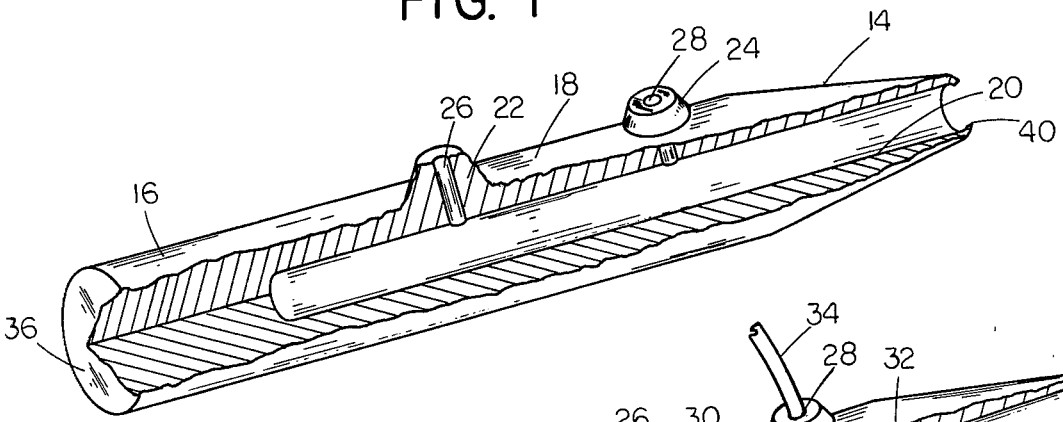
FIG. 2 is an enlarged perspective view of the blasting wedge with a portion broken away to disclose the internal structure thereof.
Figure 3:
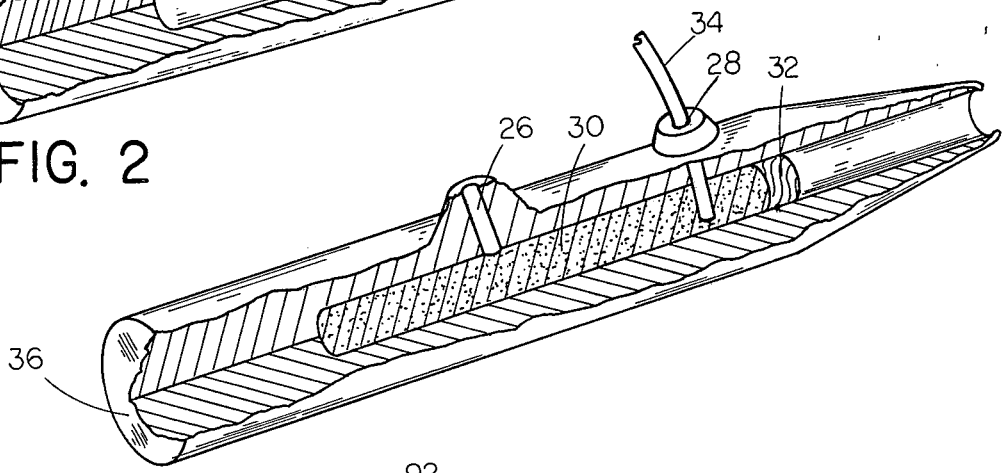
FIG. 3 is a perspective view similar to FIG. 2 showing a charge and wick inserted into the wedge.

Referring to FIGS. 2 and 3, the blasting wedge 12 of the present invention shall be described as including an elongated body having a forwardly tapered forward end portion 14, a solid rearward portion 16 and a middle portion 18 extended between and connected to the forward and rearward portions 14 and 16. An elongated axial bore 20 extends completely through the forward and middle portions and opens through the forward end of the wedge for receiving blasting powder.

A pair of longitudinally spaced-apart embossments 22 and 24 have first and second wick holes 26 and 28 formed therein for the insertion of a wick through the wedge body and into bore 20.

The provision of multiple wick holes is an important feature of the wedge 12 and materially contributes to its improved efficiency. For example, referring to FIG. 3, bore 20 is filled with blasting powder 30 to a position just forwardly of the second wick hole 28. A piece of wadding material 32 is also inserted to secure the powder in place. If a wick were inserted through the first wick hole 26 and lighted, detonation of the relatively slow burning powder would occur in the center portion thereof thereby tending to blow a portion of the unburned powder forwardly out of the wedge before it is ever detonated. By inserting the wick 34 through the second wick hole 28, however, the powder is confined within the bore rearwardly of the wick until all of the powder is detonated thereby fully contributing to the force of the blast for splitting a log.

The first and second wick holes 26 and 28 are positioned on the middle portion 18 adjacent the middle and forward end thereof respectively. The rearward end 36 is preferably flat for flush engagement against the backing structure and the forward end of the wedge may include a sharpened tip 40 which facilitates setting the wedge into a log. The wedge is preferably made of a very hard carbonated steel.

In a preferred embodiment of the invention, a two-inch diameter and 12½ inch long wedge is provided with a ¾ inch diameter bore having a 9-inch length. The wick holes 26 and 28 are positioned approximately 4 and 7 inches rearwardly of the forward end 40, respectively.

Accordingly, the bore 20 holds approximately three ounces of blasting powder with one ounce extending to just forwardly of the first wick hole 26, two ounces extending to just forwardly of the second wick hole 28 and three ounces substantially filling the bore. A three ounce charge will generally be sufficient for splitting a 10-foot long log having a diameter between 4 and 5 feet. Lesser charges will be sufficient for smaller logs. The type and age of the wood are also important considerations in selecting the appropriate size of charge for splitting a given log.

Figure 4:
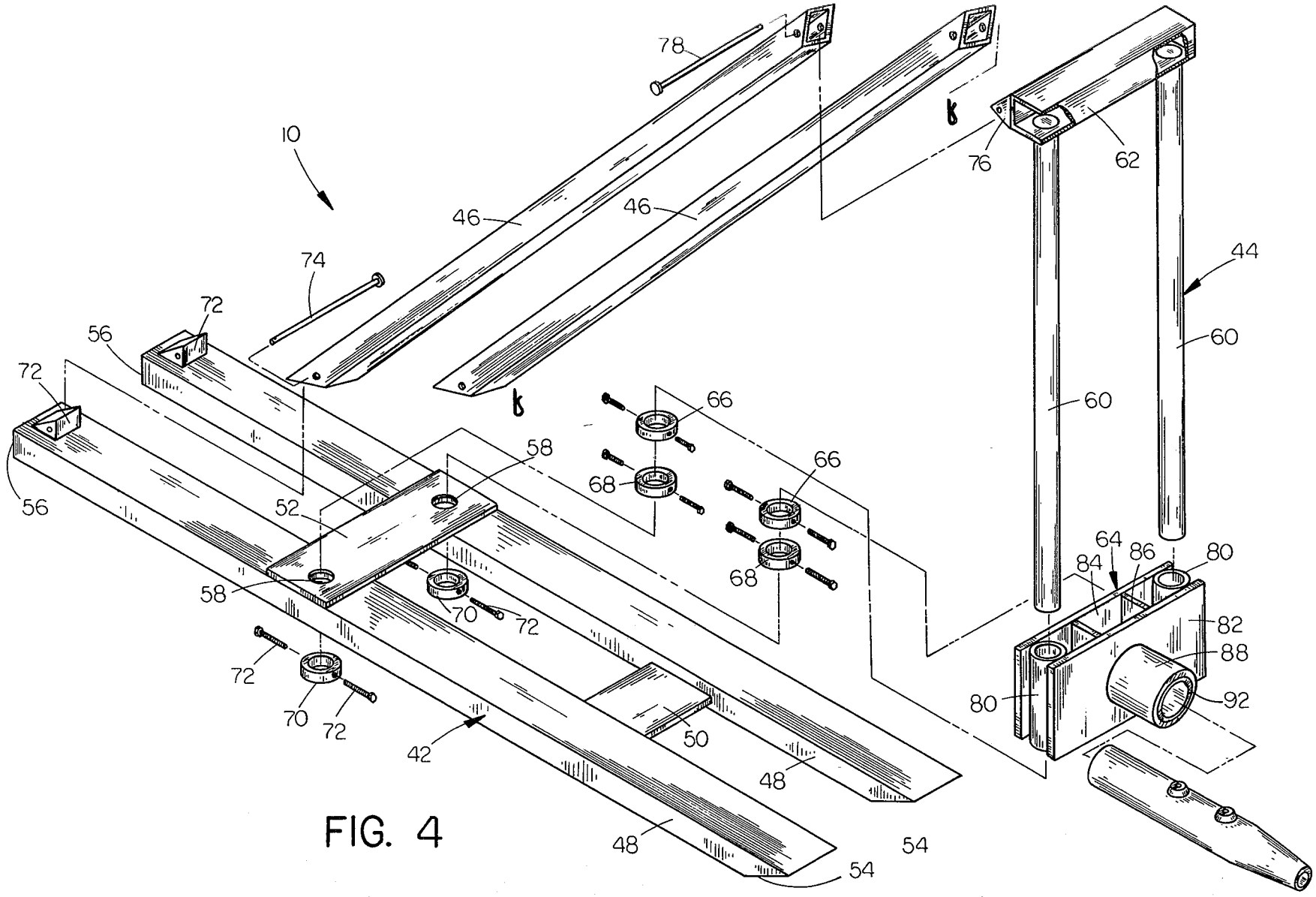
FIG. 4 is an exploded perspective view of the anchor structure.

Referring now to FIGS. 1 and 4, the anchor structure 10 includes an elongated base frame 42 having an upright backing structure 44 supported thereon and braced by a pair of elongated braces 46.

The base frame 42 includes a pair of elongated open bottomed channels 48 which are secured in parallel transversely spaced-apart relation by a front cross bar 50 and medial top plate 52. Note that the forward ends of the channels 48 are rearwardly and downwardly tapered at 54 to facilitate forward sliding movement of the anchor structure toward a log but the rearward ends of the channels 48 are vertical at 56 for digging into the ground to resist rearward sliding movement of the base frame due to recoil forces. Registered bores 58 are formed through the top of each channel 48 and each end of top plate 52 for receiving backing structure 44.

To minimize outward dishing of the channels 48, which may be caused by the channels tending to mold to the shape of logs supported thereon, front cross bar 50 may be replaced with a single longer brace which is inclined upwardly and forwardly and which extends through the inner flanges of the channels 48 for securement to the other flanges as well.

Backing structure 44 comprises a pair of upright solid rods 60 having upper ends secured to a top cross bar 62. A wedge supporting carriage 64 and a pair of stop collars 66 and 68 are slidably received on each rod 60 prior to insertion into a respective one of the bores 58. Stop collars 70 are fitted onto the lower ends of rods 60 and secured by set screws 72. The stop collars 68 are also fixed to rods 60 at a position in engagement with top plate 52.

The specific means by which the backing structure 44 is secured to base frame 42 is not critical to the present invention. For example, bottom collars 70 may be welded to the underside of the base frame and have a stop plate welded across the bottom of the collars to fix the vertical position of rods 60. The upper collars 68 could likewise be replaced with fixed pipe stubs on the top side of top plate 52 with the pipe stubs and rods 60 being provided with aligned bores for releasably receiving a lock pin.

Elongated braces 46 are formed of box iron and are adapted for removable connection to the rearward ends of channels 48 upon being fitted onto upstanding ears 72 and having a lock pin 74 inserted through registered holes therein. The upper ends of the braces are likewise similarly attached to rearwardly projected ears 76 on top cross bar 62 by a lock pin 78.

The carriage 64 is vertically slidable on rods 60 and may be fixed in an adjusted position thereon by fixing the stop collars 66 at selected positions on the rods. The carriage then rests by gravity on the fixed stop collars 66.

Figure 5:
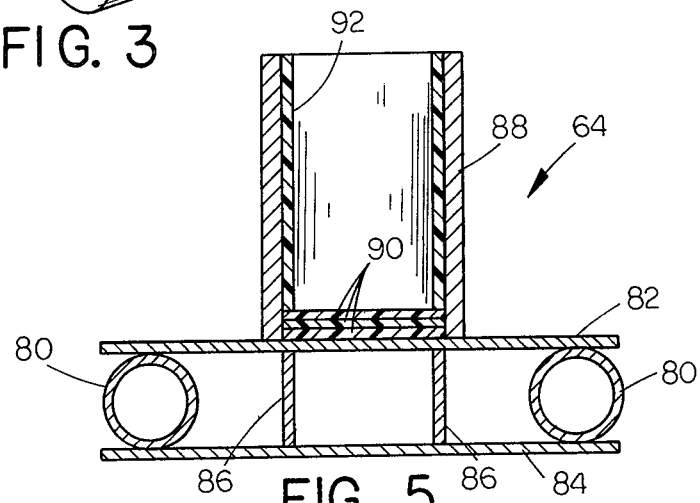
FIG. 5 is an enlarged top sectional view of the wedge holding carriage.

Referring to FIG. 5, the wedge supporting carriage 64 includes a pair of rod receiving sleeves 80 having a front base plate 82 and a rear ram plate 84 fixed thereto such as by welding. Additional reinforcement plates 86 may be welded between the base plate 82 and ram plate 84 as shown. A wedge receiving sleeve 88 is fixed onto base plate 82. A plurality of flat discs 90 of nylon or hard plastic are seated within the sleeve and retained therein by a similar nylon or hard plastic sleeve liner 92. The rearward portion of blasting wedge 12 is of a size to be slidably received within the sleeve liner 92 in close fitting relation therein.

Figure 6:
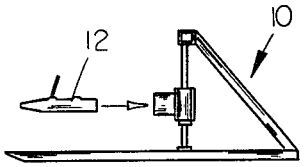
FIG. 6 shows the wedge being inserted into the anchor structure.
Figure 7:
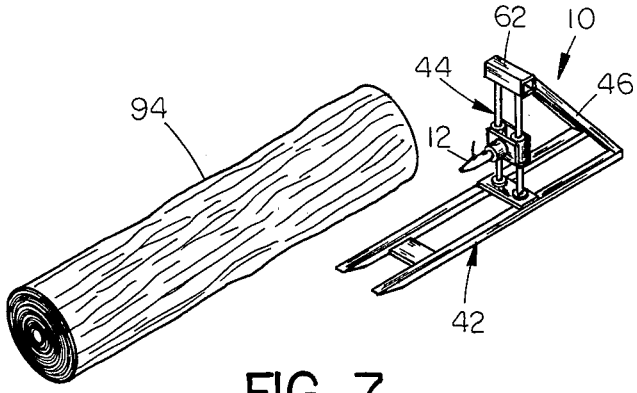
FIG. 7 shows the anchor structure placed adjacent a log.
Figure 8:
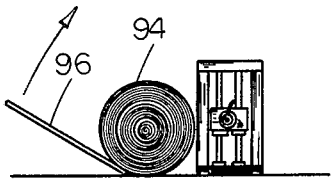
FIG. 8 shows a log being rolled onto the anchor structure.
Figure 9:
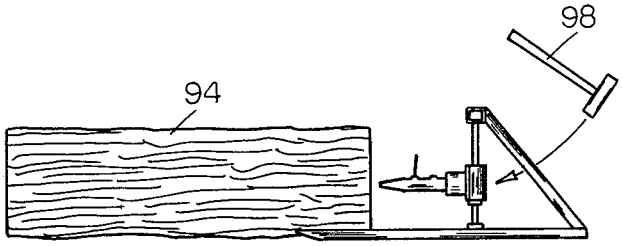
FIG. 9 shows the wedge being set into the end of a log.

In operation, a charge of blasting powder is placed in the wedge 12; a wick 34 is inserted through the appropriate wick hole 26 or 28 and the rearward portion 16 of the wedge is then axially placed onto the support sleeve 80 of carriage 64 as shown in FIG. 6. The wedge and anchor structure 10 are then ready for use and may be easily carried to the site of a log 94 by means of the top cross bar 62 which serves as a handle. The base frame 42 is placed on the ground adjacent and parallel to the log with the forward tip 40 of the wedge in clearance relation from the end of the log as shown in FIG. 7. A lever 96 (FIG. 8) may then be used to roll the log 94 onto the forward ends of the channels 48.

Figure 10:
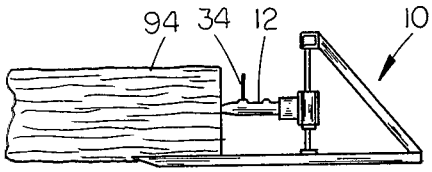
FIG. 10 shows the wedge and anchor structure as set prior to blasting.
Figure 11:
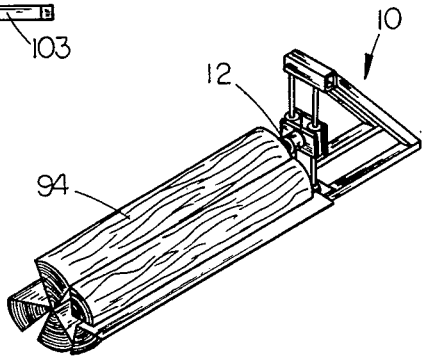
FIG. 11 shows the wedge, anchor structure and log at the completion of the blasting operation.

The wedge supporting carriage 64 is then vertically adjusted on the rods 60 by lock collars 66 to align the wedge 12 with the center of log 94. A sledge hammer 98 or the like is then driven against ram plate 84 for driving the entire anchor structure 10 forwardly toward the log and setting the wedge 12 approximately one inch or so into the log as shown in FIG. 10. The operator then need only light the wick 34 to detonate the charge for quickly and easily splitting the log into approximately three to five separate pieces as shown in FIG. 11.

The preferred blasting powder for use with the invention is of a type such as that manufactured by Goex in Musik, Penna. and which is known to be distributed by L.M.I., Inc. of Milan, Ill. and others nationwide. The powder is identified as FFB Black Blasting Powder. This is a class A powder subclassified as a propellant. It is a non-nitroglycerin based powder. More specifically, it is a relatively slow burning sodium nitrate powder which has proven safe for log splitting operations.

Figure 12:
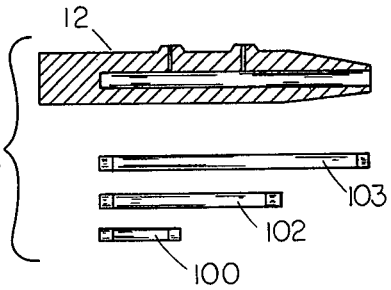

As an alternative to loading the wedge 12 with bulk powder, a plurality of pre-measured and sealed cartridges may be provided. Referring to FIG. 12, there are shown first, second and third cartridges 100, 102 and 103 which are preferably of a size to contain approximately one, two and three ounces of powder, respectively. The cartridges have a diameter slightly less than the inside diameter of bore 20 for insertion therein. The first cartridge 100 has a length greater than the longitudinal distance from the closed end of the bore to the first wick hole 26 but less than the distance to the second wick hole 28. The second cartridge 102 has a length slightly greater than the distance from the closed end of the bore 20 to the second wick hole 28 and substantially less than the overall length of the bore. Finally, the third cartridge 103 has a length substantially longer than the distance from the closed end of the bore 20 to the second wick hole 28 and slightly less than the length of the bore 20.

The cartridge loading system simplifies the use of the present invention by eliminating the measuring and handling of bulk powder. The cartridge need only be slid into the wedge and then pierced by a nail or the like inserted through one of the wick holes to facilitate insertion of a wick through the casing of the cartridge which may be plastic, cardboard or the like. Both ends of the cartridges are sealed for clean and safe handling.

Whereas a preferred embodiment of the invention has been shown and described herein, it will be readily apparent that many modifications, alterations and substitutions may be made which are within the intended broad scope of the appended claims. The anchor structure 10 in particular may be formed in various shapes so long as there is provided a means for supporting the wedge 12 at various selected vertical positions. It will be apparent that an alternate embodiment of the anchor structure 10 may be provided without tines extended forwardly from the upright backing structure. This would eliminate the step of first rolling the log onto the tines and would enable the anchor structure to simply be placed directly at the end of a log. It is also contemplated that anchor structures could be provided with forwardly extended tines with a much shorter length relative to the embodiment shown in the drawings.

Further modifications of the invention to assure its safe operation are described hereinbelow. First, registered bores could be provided through the wedge 12 and wedge receiving sleeve 88 of carriage 64 for receiving a removable lock pin to securely retain the wedge in its inserted position throughout the blasting operation. The wedge could otherwise be retained in the sleeve by any other known mechanical fastening means.

Another safety accessory for the wedge 12 is a removable cap for closing the unused wick hole and preventing the escape of blasting powder, combustion gases, etc. therefrom. This cap could be in the form of a bolt having a threaded shaft adapted for insertion into threaded wick holes. Other means for mechanically closing the caps could be suitable as well.

Finally, it is contemplated that a collapsible shield structure may be removably secured to the upright backing structure 44 to protect an operator standing behind the unit from any flying wood particles, debris or anything else which might be projected in that direction from the blast. It is contemplated that the shield could be provided as three wall members including a pair of forwardly and outwardly flared side walls having forwardly and upwardly inclined top edges onto which a top wall is placed with overlapping flanges being secured to the side walls by quick release pin connections, for example. The removable scatter shield would also help balance the anchor structure in those embodiments wherein the forward tines are shortened or eliminated.

Another possible alternative is to form the wedge 12 as an integral part of the carriage 64, although it is preferred that they be formed separately to facilitate bulk loading.

The present invention eliminates the precutting and handling of logs as required with hydraulic log splitters since the present invention is carried to the log, rather than vice versa. Likewise, a single blast is all that is required for splitting a long large diameter log into multiple pieces.

The anchor structure 10 is believed to be a new invention never heretofore known, used or otherwise disclosed prior to the development, testing and promotion thereof by the present applicant. Whereas blasting wedges, generally, were known and used in the early part of this century, they fell into disuse, presumably because the proper handling and backing of the wedges became somewhat of a lost art. With the new anchor structure of the present invention, applicant's improved wedge may be easily height adjusted for any log and is designed to be self-actuating to the extent that the very recoil forces which are being resisted serve to improve the gripping action of the anchor structure relative to the ground. Likewise, applicant's cartridge system for easily inserting premeasured loads of blasting powder into the wedge without any of the problems associated with bulk handling of powder has not heretofore been known or used. Applicant's log splitting blasting wedge and anchor system has improved the basic wedge and provided a system for using the same in an easy safe and efficient manner for quickly dividing long large diameter logs into multiple pieces of a size which can be easily manually handled.

Thus there has been shown and described an improved log splitting blasting wedge and anchor system which accomplishes at least all of the stated objects.

I claim:

1. A log blasting wedge, including an elongated body having a forwardly tapered forward end portion, a middle portion and a rearward end portion, said forward and middle portions having an axial bore therethrough, said bore having an open forward end and a closed rearward end terminating at the rearward end of said middle portion, a first wick hole through said middle portion in communication with said bore, said first wick hole being positioned in longitudinally spaced relation from said forward and rearward portions, and a second wick hole through one of said forward and middle portions in communication with said bore, said second wick hole being spaced longitudinally forwardly of said first wick hole.

2. The wedge of claim 1 wherein said second wick hole is positioned closely adjacent the juncture of said forward and middle portions.

3. In combination with the wedge of claim 1, a first blasting cartridge including a generally closed ended tubular casing substantially filled with blasting powder, said casing having a diameter slightly less than the diameter of said bore for insertion therein, and a length greater than the longitudinal distance from the closed end of the bore to the first wick hole and less than the distance from the closed end of the bore to the second wick hole.

4. The combination of claim 3 further comprising a second blasting cartridge including a second generally closed ended tubular casing substantially filled with blasting powder, said second casing having a diameter slightly less than the diameter of said bore for insertion therein, and a length slightly greater than the distance from the closed end of the bore to the second wick hole and substantially less than the length of said bore.

5. The combination of claim 4 further comprising a third blasting cartridge including a third generally closed ended tubular casing substantially filled with blasting powder, said casing having a diameter slightly less than the diameter of said bore for insertion therein, and a length substantially longer than the distance from the closed end of the bore to the second wick hole and slightly less than the length of said bore.

6. An apparatus for supporting a blasting wedge relative to a log to be split, comprising, an elongated base frame having forward and rearward ends, said forward end adapted to support one end of a log to be split, an elongated backing structure having upper and lower ends, means for mounting said backing structure in upright relation on a medial portion of said base frame, elongated brace means having upper and lower ends, means for connecting the upper end of said brace means to said backing structure adjacent the upper end thereof, means for connecting the lower end of said brace means to said base frame adjacent the rearward end thereof, a blasting wedge carriage vertically adjustably mounted on said backing structure, said carriage including means for supporting a blasting wedge in forwardly directed generally horizontal relation thereon, and means for releasably securing said carriage at a selected vertical position on said backing structure whereby said wedge may be supported in substantially aligned relation with the center of a log supported on said forward end of the base frame.

7. The apparatus of claim 6 wherein said carriage further comprises a ram plate on a rearward side thereof whereby, upon striking said ram plate, the apparatus may be driven forwardly for embedding the forward end of a wedge into the center of a log.

8. The apparatus of claim 6 wherein said backing structure comprises an upright slide track and said carriage is vertically slidably mounted on said slide track.

9. The apparatus of claim 8 wherein said slide track and brace means are detachable from one another and from said base frame.

10. The apparatus of claim 8 wherein said slide track comprises a pair of elongated bars and means for supporting said bars in tranversely spaced-apart relation.

11. The apparatus of claim 10 wherein said carriage comprises a pair of transversely spaced-apart sleeves adapted for slidably receiving said bars therethrough and a cross member connected to and extended between said space.

12. The apparatus of claim 11 wherein the means for supporting a blasting wedge comprises an open forward ended support sleeve secured to said cross member.

13. The apparatus of claim 6 wherein said base frame comprises a pair of elongated open bottomed channel members and means for securing said channel members in parallel spaced-apart relation.

14. The wedge of claim 1 further comprising a removable closure means for at least one wick hole and means for removably securing said closure means on said one wick hole.

15. A method of splitting logs, comprising providing a blasting wedge and an anchor structure for height adjustably supporting the wedge, placing a charge of blasting powder in the wedge, supporting the wedge on said anchor structure, moving said anchor structure into position at the end of a log with said cartridge directed longitudinally of the log, adjusting the height of the wedge to substantially align the wedge with the center of the log, driving the entire anchor structure and wedge toward the end of the log thereby setting the wedge into the end of the log, and igniting the charge in the wedge.

16. The method of claim 15 further comprising providing said anchor structure with a pair of forwardly extended and transversely spaced apart ground engaging tines, and the step of moving the anchor structure into position at the end of the log comprises placing said tines in parallel relation adjacent one side of the end of a log and rolling said log onto the tines.

17. An apparatus for supporting an elongated blasting wedge, having forward and rearward ends, relative to a log to be split, comprising, an elongated base frame having forward and rearward ends, an elongated backing structure having upper and lower ends, means for mounting said backing structure in upright relation on said base frame, an elongated brace means having upper and lower ends, means for connecting the upper end of said brace means to said backing structure, means for connecting the lower end of said brace means to said base frame, a blasting wedge carriage vertically adjustably mounted on said backing structure, said carriage including means for supporting a blasting wedge in forwardly directed generally horizontal relation thereon, and means for releasably securing said carriage at a selected vertical position on said backing structure whereby said wedge may be supported in substantially aligned relation with the center of a log supported on said forward end of the base frame, said means for supporting a blasting wedge comprising a wedge receiving sleeve having an open forward end and rearwardly extending opening therein adapted to receive the rearward end of an elongated blasting wedge in close fitting relation therein and abutment means within said opening operative to limit the extent of rearward insertion of a blasting wedge into said opening.

* * * * *